US005315761A

United States Patent [19]

Norton et al.

[11] Patent Number: 5,315,761

[45] Date of Patent: May 31, 1994

[54] SHEATH WITH ADJUSTABLE LATCHING ASSEMBLY

[75] Inventors: Donald C. Norton, Beaverton; George C. Sessions, Milwaukie, both of Oreg.

[73] Assignee: Fiskars Inc., Wausau, Wis.

[21] Appl. No.: 98,459

[22] Filed: Jul. 27, 1993

[51] Int. Cl.[5] ..... B26B 3/06; B26B 79/02

[52] U.S. Cl. ..... 30/162; 30/164

[58] Field of Search ..... 30/162, 164, 151, 143; 403/329, 330

[56] References Cited

U.S. PATENT DOCUMENTS

| | | | |
|---|---|---|---|
| 1,237,075 | 8/1917 | Martelli | 224/232 |
| 3,439,419 | 4/1969 | Fleming | 30/162 |
| 3,958,330 | 5/1976 | Hutchens | 30/151 |
| 4,495,696 | 1/1985 | Fethke et al. | 30/135 |
| 4,558,516 | 12/1985 | Collins | 30/151 |
| 4,827,614 | 5/1989 | Mitchell | 30/151 |
| 4,980,977 | 1/1991 | Matin et al. | 30/151 X |
| 5,067,239 | 11/1991 | Collins | 30/164 X |
| 5,123,167 | 6/1992 | Kelley | 30/151 |
| 5,255,436 | 10/1993 | Yoshida | 30/151 |

*Primary Examiner*—Richard K. Seidel
*Assistant Examiner*—Kenneth E. Peterson
*Attorney, Agent, or Firm*—Foley & Lardner

[57] ABSTRACT

A sheath which permits the user to adjust the degree of retentional engagement of the knife within the sheath. The sheath is provided with a simple, adjustable, latch mechanism engaging the knife to prevent their accidental disengagement. The latch mechanism is substantially received within the sheath.

20 Claims, 2 Drawing Sheets

SHEATH WITH ADJUSTABLE LATCHING ASSEMBLY

FIELD OF THE INVENTION

The present invention relates, generally, to a sheath having a mechanism to lock an elongated article, such as an item of cutlery, a tool, or the like, within the sheath. In particular, this invention is concerned with a sheath comprising an adjustable retention mechanism intended to permit the user to adjust the retaining force of the sheath on the tool. Although it will become apparent from the following description that the present invention may be utilized with tools of various construction having a working member or surface, singular or compound, and preferably having a longitudinal dimension equal to or exceeding the lateral dimension, for ease of understanding and convenience, the following description will from time to time specifically refer to a knife/sheath as the most preferred implementation of the present invention.

BACKGROUND OF THE INVENTION

Tools such as knives having a handle and a blade are often carried in sheaths attached to an article of clothing of the user. Certain prior art sheaths undesirably allow the knife to often become dislodged from the sheath when the user is active or when the sheath is not in an upright position. Various methods to prevent the knife from falling out of the sheath, or otherwise becoming dislodged, are well known in the art. U.S. Pat. No. 3,958,330, issued May 25, 1976 to Hutchens discloses a knife and sheath combination wherein the knife and sheath are provided with mating areas to prevent the accidental release of the knife from the sheath.

Other more complex mechanisms have also been used to alleviate this problem. In particular, U.S. Pat. No. 4,827,614, issued May 9, 1989 to Mitchell discloses a double safety lock and quick release tool and sheath assembly in which the locking mechanism includes a pair of spring-biased pins secured to the handle of the tool. The two locking pins protrude above the surface of the tool handle and tightly fit within two corresponding apertures of the tool holder. The locking mechanism also includes two activators which permit the user to release the tool from the tool holder. Similarly, U.S. Pat. No. 5,123,167, issued June 23, 1992 to Kelley is directed to a knife in which the handle is provided with an integral latch member displaceable by the fingers of the user. The latch engages a corresponding aperture formed in the knife sheath.

From the foregoing, it is readily apparent that these prior art inventions suffer from a number of shortcomings. In particular, and most importantly, all such prior art items do not permit adjustment of the retaining force of the knife within the sheath In addition, in some of these items, numerous parts and complex assemblies are required to establish this retentional feature Finally, and as illustrated by Kelley, recent attempts to find simpler ways to provide the desirable interlocking of the knife with the sheath have resulted in the knife itself comprising an exposed, cumbersome, fragile, locking mechanism which may impede operation of the knife by the user, and which may be damaged during normal use of the knife.

Thus, it is highly desirable to provide a sheath which can alleviate the problems associated with conventional interlocking knife/sheath combinations, i.e., which permits adjustment of the force retaining the knife within the sheath, which is of simple construction yet durable, and which does not impede operation of the knife by the user.

SUMMARY OF THE INVENTION

A sheath in accordance with the present invention is characterized in that it permits the user to adjust the degree of retentional engagement of the knife within the sheath. The sheath is provided with a simple, adjustable, latch mechanism interlocking the knife and the sheath to prevent their accidental disengagement. According to the present invention, the latch mechanism is substantially received within the sheath, as opposed to being exposed as part of the knife handle, and cooperates with a knife of typical construction to permit adjustment of the retaining force of the sheath on the knife.

According to a preferred embodiment of the present invention, in a sheath having an adjustable retention mechanism, a biased latching assembly is provided with a biasing element integrally molded with the sheath and engageable with a button The retaining force established by the latching assembly is adjustable by movement of the button relative to the biasing element Additionally, the sheath may be provided with a reversible clip, allowing the user to carry the knife and sheath in an inverted position.

BRIEF DESCRIPTION OF THE DRAWINGS

The preferred exemplary embodiment of the present invention will hereinafter be described in conjunction with the appended drawings, wherein like numerals denote like elements, and.

DETAILED DESCRIPTION OF A PREFERRED EXEMPLARY EMBODIMENT

Figure 1:
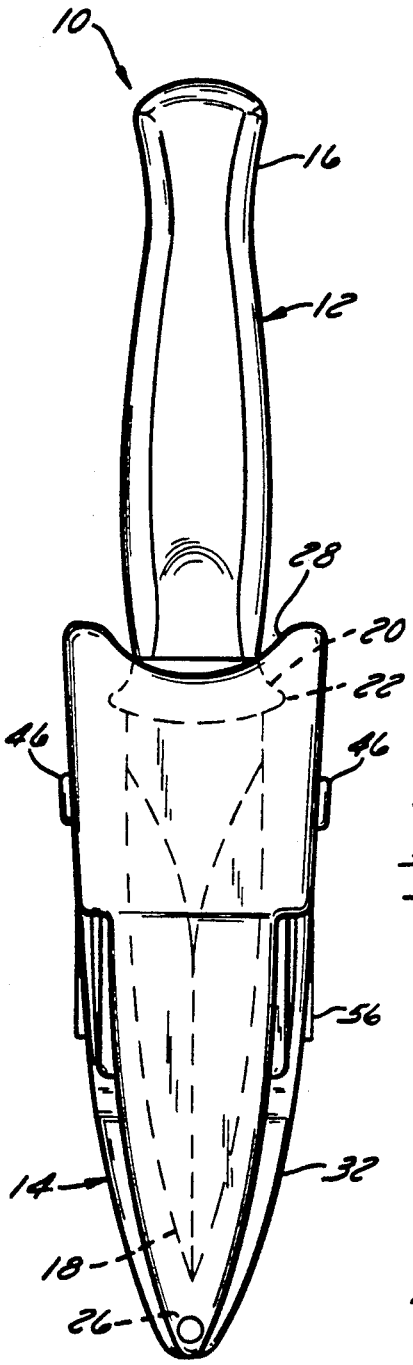
FIG. 1 is a front elevational view of a knife and sheath combination according to the present invention.

Referring to the figures, a knife/sheath combination in accordance with the present invention, designated generally as 10, comprises a knife 12 and a sheath 14 of complementary configuration. Knife 12 comprises a handle 16 and a working member or surface 18, more commonly called a blade. In light of the fact that combination 10 is shown in the figures as being substantially symmetrical with respect to its longitudinal axis, for ease of understanding and convenience, knife 12 and sheath 14 will hereinafter be described in terms of generically denominated components, equally referring to areas of the left side or the right side of combination 10.

Knife 12 comprises, intermediate handle 16 and blade 18, an outwardly projecting region designated generally as 20. Projecting region 20 comprises projections 22 radially extending with respect to the longitudinal axis of knife 12 (i.e., an axis drawn vertically in FIG. 1). It should be noted that the longitudinal axis of knife 12 is preferably linear, although it can acceptably be curved or arcuate, but generally without its own reentrant geometry to permit its insertion in a sheath.

Sheath 14 is defined by an elongated passage 24 having a first end 26 and an opposed open end 28. Elongated passage 24 accommodates insertion and withdrawal of knife 12 along the longitudinal axis of combination 10, and is typically configured to receive at least blade 18. Sheath 14, which may be formed by molding a rigid material such as plastic, comprises an integrally formed, advantageously V-shaped, inner member 30 spaced apart from an outer shell 32. If preferred, sheath 14 could be fabricated of other resilient material Sheath 14 also includes an adjustable biased latching assembly generally designated as 34 for retaining knife 12 within sheath 14. Latching assembly 34 comprises a first resiliently flexible biasing element 36 which is connected to inner member 30 at a fixed proximal end 38 and which terminates at a distal free end 40. First biasing element 36, which is advantageously integrally molded with inner member 30, has oppositely facing inner and outer surfaces 42, and 44, respectively Latching assembly 34 also comprises a second biasing element 46, advantageously shaped as a button comfortably engageable by a finger of the user. Second element 46 is substantially disposed within a longitudinal slot 48, formed in outer shell 32, having an upper terminus 50 proximate open end 30, and an opposed lower terminus 52, proximate fixed end 38. Second element 46 slidably engages first element 36 over outer surface 44 between upper terminus 50 and lower terminus 52. Since first element 36 is connected to V-shaped inner member 30 which is received within outer shell 32, first element 36 is disposed at an angle respective the path of travel of second element 46 along slot 48.

Figure 2:
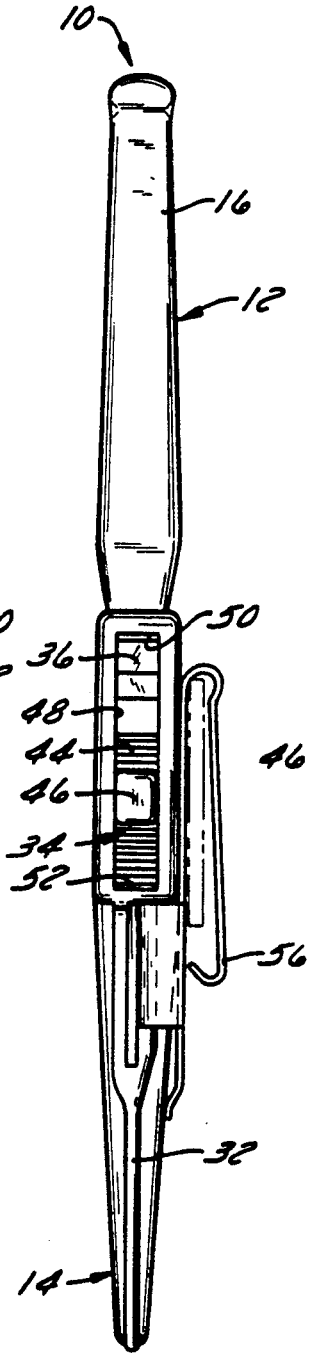
FIG. 2 is a side elevational view of the combination of FIG. 1.
Figure 4:
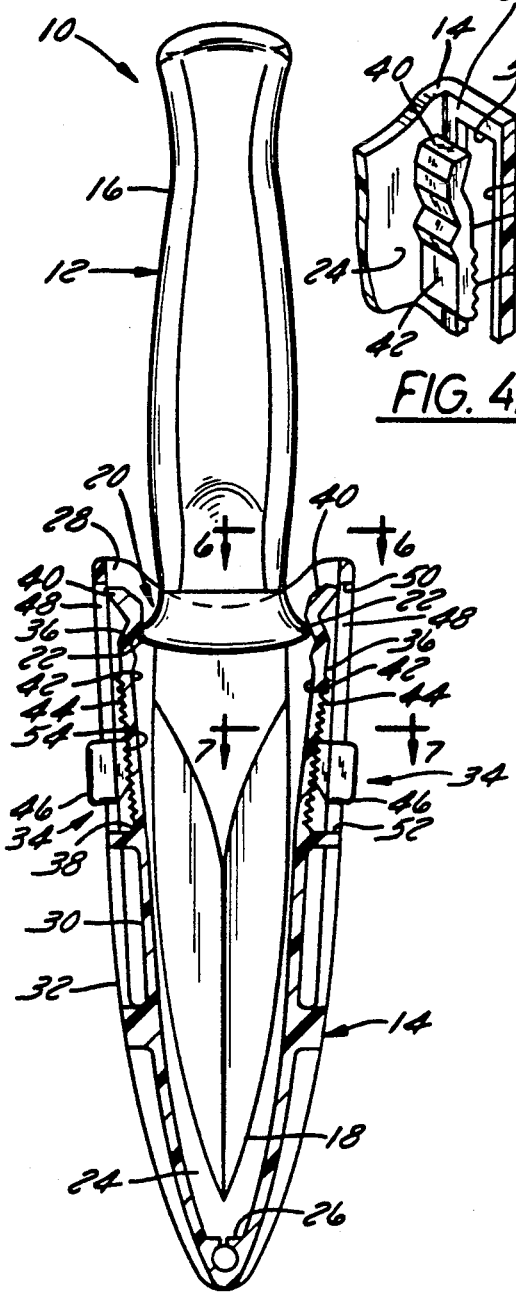
FIG. 4 is a longitudinal cross sectional view of the sheath of FIG. 1, with a front view of the knife therein.
Figure 4A:
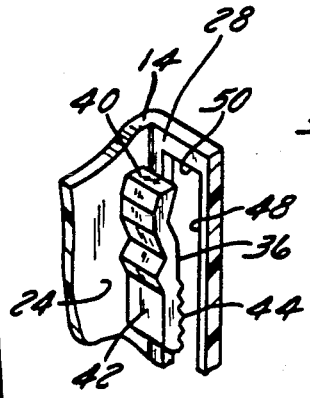
FIG. 4A is a partial perspective view of the open end of the sheath of FIG. 1.
Figure 5:
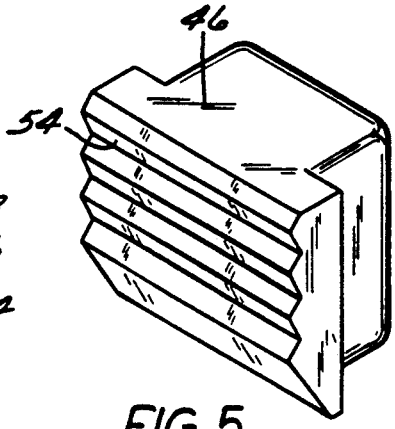
FIG. 5 is a perspective view of a button shown in FIG. 4.
Figure 6:
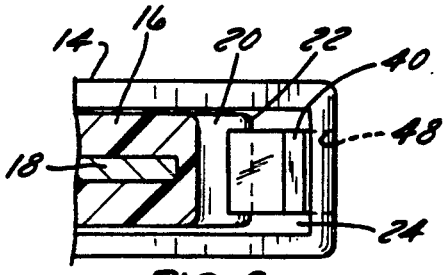
FIG. 6 is a cross sectional view taken along line 6—6 shown in FIG. 4.
Figure 7:
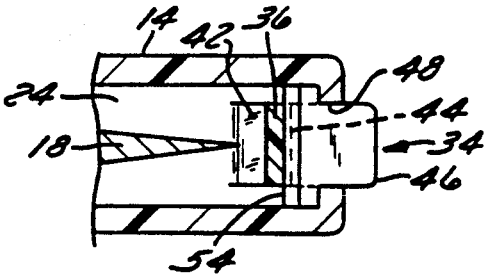
FIG. 7 is a cross sectional view taken along line 7—7 shown in FIG. 4.

As more particularly seen in FIGS. 2, 4, and 4A, by sliding second biasing element 46 along outer surface 44 toward upper terminus 50, first biasing element 36 is forced inwardly (i.e., toward the inner region of elongated passage 26), thereby increasing the force applied generally normally to the longitudinal axis of knife 12 by free end 40 on region 20 to retain knife 12 within sheath 14. Thus, the interlocking engagement of sheath 14 with knife 12 is increased, as a result. Conversely, when second biasing element 46 slides downwardly toward lower terminus 52, greater radial displacement of free end 40 with respect to region 20 is permitted, i.e., the force applied normally to region 20 by free end 40 is reduced. Accordingly, relative movement of second element 46 and first element 36 between upper terminus 50 and lower terminus 52 permits adjustment, within a range from a maximum to a minimum, respectively, of the amplitude of the force effectively retaining knife 12 within sheath 14.

To facilitate adjustment by the user of the retaining-effective force, outer surface 42 is preferably sawtoothed, matingly engaging the inwardly facing surface 54 of second biasing element 46. This construction allows incremental movement of second element 46 relative to first element 36, resulting in incremental adjustment of the degree of interlocking engagement of sheath 14 and knife 12.

Figure 3:
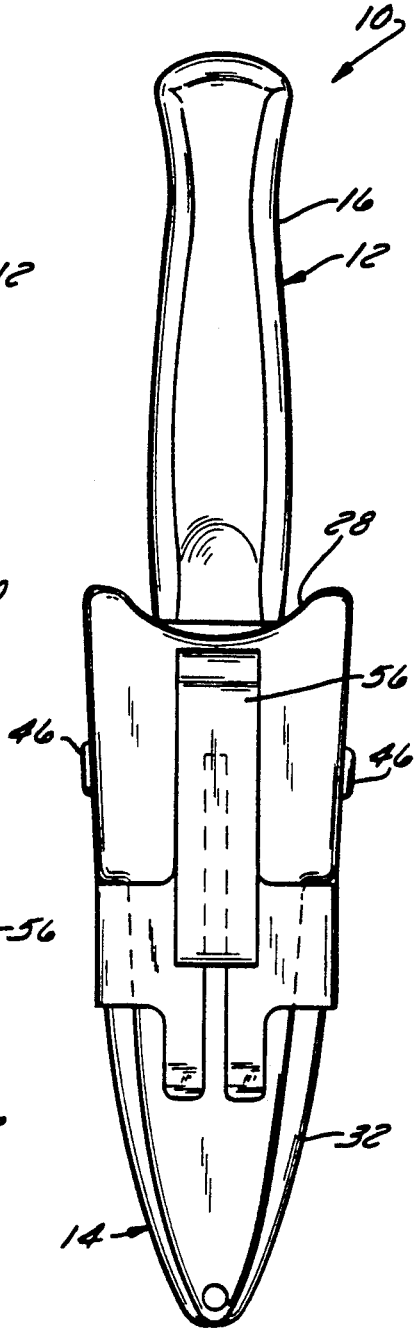
FIG. 3 is a rear elevational view of the combination of FIG. 1.

Referring to FIGS. 2 and 3, sheath 14 is also provided with a reversible clip 56 releasably engaging outer shell 32. In particular, clip 56 may be slid off scabbard 14 by moving clip 56 toward first end 26 and rotating clip 56 so as to permit the user to carry combination 10 in an inverted position. While adjustability of the retaining-effective force ensures the user that knife 12 will not accidentally become dislodged from sheath 14 when combination 10 is carried in the inverted position, knife 12 remains readily accessible.

Accordingly and as explained in the foregoing, the relative movement of biasing elements 36 and 46 of latching assembly 34 permits adjustment of the force applied generally normally to the longitudinal axis of combination 10, thus, in effect, providing adjustment of the force retaining knife 12 within sheath 14. Such retaining-effective force, which must be overcome by the user during insertion of knife 12 in sheath 14 (or removal therefrom), can therefore be adjusted to the level desired by the user depending on the type of activity in which the user is engaged, or on the frequency of use of the knife.

It is understood that the above description is of a preferred exemplary embodiment of the present invention and that the invention is not limited to the specific forms described herein. For example, non-planar tools such as screwdrivers may also be protected in a sheath having a similarly adjustable latching assembly In such cases, the outwardly projecting annular region (i.e., the finger guard which is typically formed at the base of the handle of such tools) cooperates with the displaceable free end of a first biasing element, thereby permitting adjustment of the interlocking engagement of such region with such element. Moreover, even though the embodiment shown in the figures is the preferred embodiment, it is to be noted that this invention, which is based on a sheath having an adjustable biased latching assembly to permit the user to adjust the degree of interlocking engagement of the tool with the sheath, can be carried out in other manners. For example, the adjustable latching mechanism need not have the configuration disclosed herein. However, such other constructions and features are considered to be within the scope of this invention. Accordingly, these and other substitutions, modifications, changes and omissions may be made in the design and arrangement of the elements disclosed herein without departing from the scope of the appended claims.

We claim:

1. A sheath and tool combination comprising a tool having a handle and a blade extending therefrom along a longitudinal axis, and a sheath having a complementary configuration for receiving at least said blade through an opening in said sheath, said sheath including a biased latching assembly for retaining said tool therein by establishing a retaining-effective force generally normal to said axis which resists but may be overcome by a withdrawal force applied axially by a user to remove said tool from said sheath, said latching assembly being comprised of a first biasing element engageable with a second biasing element, wherein the relative movement of said elements by a user changes said retaining-effective force within a range from a minimum to a maximum force.

2. The combination of claim 1 comprising at least two each of said first and second biasing elements.

3. The combination of claim 2, wherein said first biasing element is disposed at an angle with respect to a path of travel of said second biasing element.

4. The combination of claim 3 further comprising a longitudinally extending slot formed in said sheath to define the path of travel of said second biasing element.

5. The combination of claim 1, wherein said first biasing element is comprised of a resilient pivotal member having a free end and a fixed end, and wherein a movement of said second element between said free end and said fixed end defines said range.

6. The combination of claim 3, wherein said first and second elements comprise engageable sawtooth regions to permit incremental variation of said retaining-effective force within said range.

7. The combination of claim 5 wherein the maximum retaining-effective force is established when said second element is proximate said free end.

8. The combination of claim 5, wherein said first biasing element is integrally molded with said sheath.

9. An interlocking sheath and tool combination comprising:

a. an elongated tool having a blade connected to a handle and an outwardly projecting region disposed intermediate said handle and said blade; and b. a sheath being defined by i. an elongated passage having a longitudinal axis, said passage having a first end and an opposed open end for accommodating insertion and withdrawal of said tool along said axis; and ii. a biased latching assembly for releasably retaining said tool in said sheath, said latching assembly extending inwardly into said passage and being engageable to a degree of engagement with said projecting region when said tool is inserted into said sheath, wherein said latching assembly is adjustable so that the degree of engagement of said tool and said sheath can be adjusted as desired by the user.

10. The combination of claim 9 wherein said latching assembly comprises a pair of oppositely facing, resiliently flexible, first biasing elements each having a fixed end and a distal free end, said first elements being connected to said sheath at said fixed ends, said free ends being releasably engageable with said region when said tool is inserted into said sheath.

11. The combination of claim 10 wherein said first elements are formed integrally with said sheath.

12. The combination of claim 10 wherein said latching assembly further comprises a pair of second biasing elements respectively engageable with said first elements, wherein a relative movement of said second elements and said respective first elements determines the degree of interlocking engagement of said tool and said sheath.

13. The combination of claim 12 wherein said latching assembly is disposed at an angle to said axis so that proportionally greater interlocking engagement of said free ends with said region is provided when said second elements are proximate said open end.

14. The combination of claim 12 wherein said first biasing element has oppositely facing inner and outer surfaces, said outer surface being sawtoothed, and said second biasing element is formed as a button having an engageable surface and an opposed inwardly facing surface, said inwardly facing surface being sawtoothed to matingly engage said outer surface so that the degree of interlocking engagement of said free ends with said region is incrementally adjustable.

15. The combination of claim 14, wherein said elongated passage is further defined by a pair of spaced apart walls joined by a pair of opposing sides in which respective longitudinally extending slots are formed to define a path of travel of said button.

16. A sheath defining an elongated passage having a longitudinal axis and at least one open end through which at least the blade of a tool may be inserted, said sheath comprising a biased latching assembly for retaining said tool therein by establishing a retaining-effective force generally normal to said axis which resists but may be overcome by a withdrawal force applied axially by a user to remove said tool from said sheath, said latching assembly being comprised of a plurality of first biasing elements engageable with respective second biasing elements, wherein a movement by a user of said first elements relative said respective second elements changes said retaining-effective force within a range from a minimum to a maximum force.

17. The sheath of claim 16 wherein said second biasing elements are independently movable relative said respective first biasing elements.

18. The sheath of claim 16 further comprising an outer shell and an inner member, and wherein said latching assembly is substantially received within said outer shell.

19. The sheath of claim 18 wherein said outer shell is integrally molded with said inner member.

20. The sheath of claim 19 wherein said first element is integrally molded with said inner member.

* * * * *

UNITED STATES PATENT AND TRADEMARK OFFICE

CERTIFICATE OF CORRECTION

PATENT NO. : 5,315,761

DATED : May 31, 1994

INVENTOR(S) : Donald C. Norton and George C. Sessions

It is certified that error appears in the above-indentified patent and that said Letters Patent is hereby corrected as shown below:

In issued claim 6, column 5, line 9, delete "3" and substitute therefor --5--.

Signed and Sealed this

Twenty-third Day of August, 1994

*Attest:*

Bruce Lehman

BRUCE LEHMAN

*Attesting Officer*

*Commissioner of Patents and Trademarks*